United States Patent [19]

Broscheit et al.

[11] 3,985,145

[45] Oct. 12, 1976

[54] METHOD AND APPARATUS FOR CHANGING THE MOISTURE CONTENT OF TOBACCO

[75] Inventors: Wolfgang Broscheit, Trittau; Peter Schwarz, Rellingen; Waldemar Wochnowski, Hamburg-Meiendorf, all of Germany

[73] Assignee: Hauni-Werke Korber & Co., KG, Hamburg, Germany

[22] Filed: July 30, 1974

[21] Appl. No.: 493,063

[30] Foreign Application Priority Data

Aug. 10, 1973 Germany ..... 2340490

[52] U.S. Cl. ..... 131/135; 131/140 R

[51] Int. Cl.[2] ..... A24B 3/04

[58] Field of Search ..... 131/135, 140, 21 R; 34/46, 48, 228

[56] References Cited

UNITED STATES PATENTS

| | | | |
|---|---|---|---|
| 2,606,372 | 8/1952 | Foulder et al. | 34/46 |
| 2,763,069 | 9/1956 | Vaughan | 34/228 |
| 3,372,488 | 3/1968 | Koch et al. | 34/46 |
| 3,389,707 | 6/1968 | Wochnowski | 131/135 |
| 3,409,025 | 11/1968 | Wochnowski | 131/135 |
| 3,578,299 | 5/1971 | Hurlbut | 34/46 X |
| 3,760,816 | 9/1973 | Wochnowski | 34/48 X |
| 3,795,984 | 3/1974 | Meyer | 131/135 X |
| 3,840,025 | 10/1974 | Fowler et al. | 131/135 |

*Primary Examiner*—Robert W. Michell
*Assistant Examiner*—V. Millin
*Attorney, Agent, or Firm*—Peter K. Kontler; John Kurucz

[57] ABSTRACT

Moist tobacco is conveyed through a rotating drum which is heated by steam circulating coils and wherein a current of hot air is caused to flow counter to the direction of tobacco transport. The moisture content of conditioned tobacco is monitored by a detector which produces a first signal when the monitored moisture content deviates from a desired moisture content. The first signal is used to rapidly change the temperature of the air current from a standard temperature by adjusting the position of a valve which mixes hot air with cooler air whereby the extent of adjustment corresponds to the extent of deviation of monitored moisture content from desired moisture content. A second signal whose intensity is indicative of the extent of valve adjustment is transmitted to the input of a proportional-plus-integral amplifier which immediately changes the steam pressure in the coils and additionally changes the steam pressure while the temperature of the hot air current deviates from the standard temperature. The valve is reset to a position corresponding to the standard temperature of the air current whereupon the deviation of monitored moisture content from desired moisture content is counteracted exclusively by the changed temperature of the drum and coils as a result of adjustment of steam pressure in the coils.

7 Claims, 1 Drawing Figure

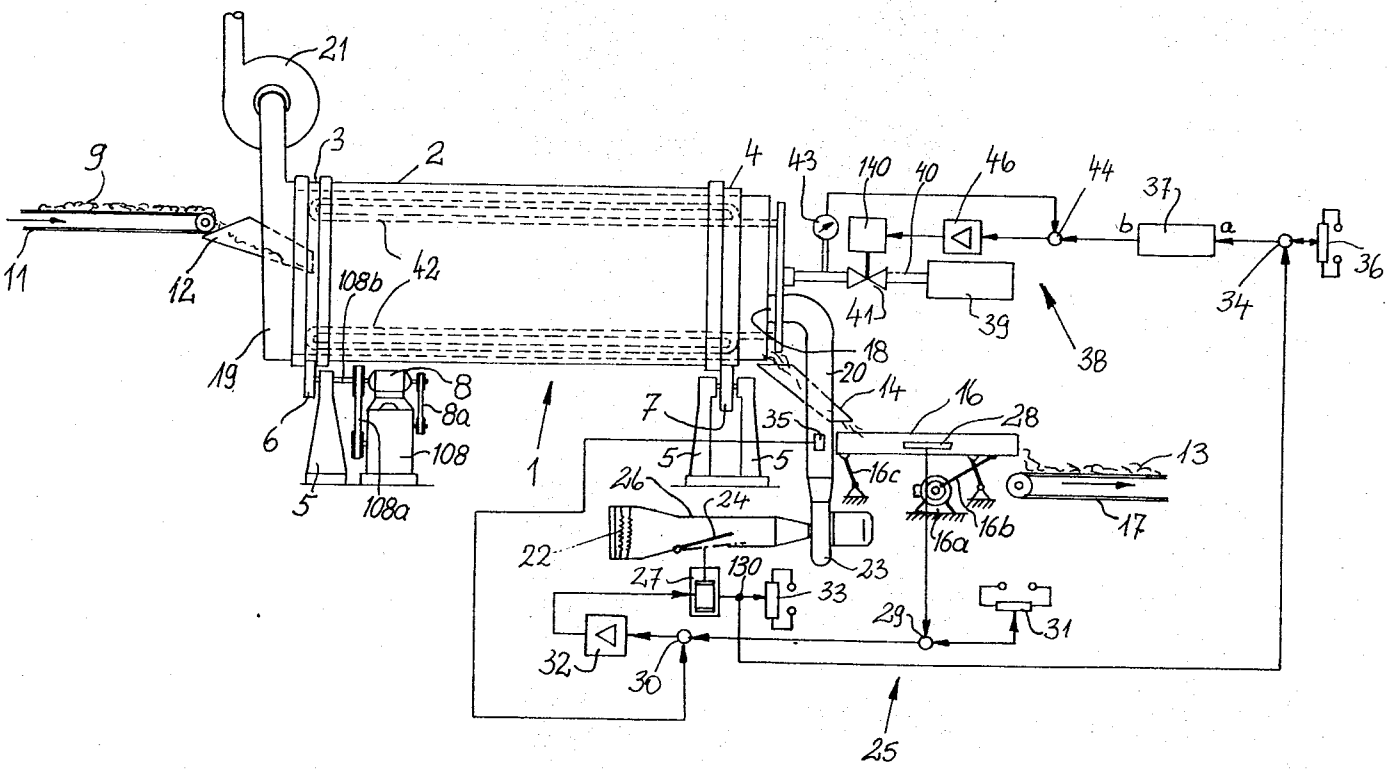
36
34
a
37
b
44
38
46
39
40
140
41
43
4
18
20
14
35
5
7
5
24
26
22
1
13
17
28
16
16b
16a
16c
23
33
31
29
25
130
27
30
32
2
42
108b
8
8a
108
108a
21
3
6
19
12
9
11

METHOD AND APPARATUS FOR CHANGING THE MOISTURE CONTENT OF TOBACCO

BACKGROUND OF THE INVENTION

The present invention relates to a method and apparatus for conditioning fibrous materials, and more particularly for changing the moisture content of tobacco particles, such as whole tobacco leaves, tobacco leaf laminae, ribs, stem, shreds and/or fragments of reconstituted tobacco.

It is known to reduce the moisture content of moist tobacco particles by conveying a stream of moist particles through a conditioning zone wherein the particles are heated by a current of heated air and by parts of a conveyor which defines the conditioning zone. In many instances, the moisture content of tobacco particles is reduced while the particles travel through a hollow drum which rotates about its axis and is heated by steam, heated air combustion products or another second conditioning. The current of hot gaseous medium is normally conveyed through the rotating drum counter to the direction of tobacco transport so that the particles which are close to the tobacco discharging end of the drum are contacted by a relatively hot gas and the particles which are located at the tobacco receiving end of the drum are contacted by a gas whose temperature is lower than at the discharge end. Similar apparatus are used to increase the moisture content of tobacco. The current of gas then carries moisture and the rotating drum surrounds at least one nozzle serving to discharge a spray of atomized liquid which contacts the particles during travel through the conditioning zone.

It is also known to automatically regulate the conditioning action in response to deviations of the moisture content of conditioned tobacco from a desired moisture content. As a rule, the detection of unsatisfactory moisture content of conditioned tobacco entails an immediate change in the conditioning action of the gaseous medium which is in direct contact with tobacco in the conditioning zone. This is desirable because, though the conditioning effect of a gas (e.g., hot air) upon tobacco is rather limited, the temperature of the gas can be changed with a minimum of delay (i.e., the time constant of the gas is relatively short) so that the moisture content of tobacco can be changed, at least within certain limits, practically immediately as soon as a detector produces a signal which indicates that the final moisture content is excessive or too low.

On the other hand, the range of the action of that medium which conditions tobacco by way of the conveyor is wider but the time constant is longer (i.e., the conveyor can change the moisture content of tobacco to a much greater extent than the first medium but it takes much longer to change the conditioning action of the conveyor). This applies not only when the particles of tobacco are treated to reduce their moisture content (by a hot first medium and a heated conveyor) but also when the moisture content of tobacco must be increased (by contact with a moisture-laden first medium and by means of one or more nozzles which spray water or another liquid onto particles in the conditioning zone). The longer time constant of the second medium is attributable to thermal inertia of those parts of the conveyor which contact tobacco in the conditioning zone during drying of tobacco, or is intentional (when the moisture content is being increased because a rapid change in the rate of discharge of atomized liquid is likely to cause undesirable and uncontrollable fluctuations of the final moisture content).

In heretofore known tobacco conditioning plants, the regulation of conditioning action by the first and second media is not entirely satisfactory, especially as regards the compensation for longer-lasting deviations of measured moisture content of conditioned tobacco from a desired moisture content. Such situation can arise when the initial moisture content of particles in a first portion of a tobacco stream which is being transported through the conditioning zone deviates considerably from the moisture content of particles in the next-following portion of the stream. The problem is aggravated because it is desirable to maintain the conditioning action of the first medium at a predetermined average or median value so that such conditioning action can be changed without delay in either direction (to bring about a more or less pronounced drying or wetting of tobacco) as soon as the measured moisture content again deviates from a desired value. In other words, the first medium should normally remain in a state which can be changed, without delay and to a considerable extent, so as to rapidly effect an increase or a reduction of the moisture content. This would be impossible if the first medium were in a state in which its action upon the material to be treated could be changed in a single direction. For example, and assuming that the material to be treated is moist tobacco and the first medium is air which is normally maintained at a maximum temperature to bring about a rather pronounced drying action. If the moisture content of conditioned tobacco is excessive, such moisture content can be reduced only by changing the temperature of the conveyor because the air is already heated to maximum temperature and is incapable of further intensifying its moisture-expelling effect.

SUMMARY OF THE INVENTION

An object of the invention is to provide a novel and improved method of changing the moisture content of tobacco or other fibrous material by means of several fluid media (particularly heated air and steam or hot combustion products) in such a way that any and all deviations of the moisture content of conditioned material from a desired moisture content can be eliminated automatically, practically immediately, and by resorting to relatively simple and inexpensive instrumentalities.

A further object of the invention is to provide a novel and improved conditioning apparatus wherein a first medium is used to immediately change the moisture content of fibrous material when the measured moisture content deviates from a desired moisture content and a second medium is used to counteract longer-lasting deviations of measured moisture content from the desired moisture content, and to provide novel and improved control means for use in a tobacco conditioning apparatus wherein tobacco is conditioned by heated air and by a second fluid which controls the temperature of parts of the conveyor which is used to transport particles of tobacco through the conditioning zone.

Still another object of the invention is to provide the control system with novel and improved means for changing the heating action of the conveyor in response to changes in the temperature of hot air upon detected deviation of measured moisture content of conditioned tobacco from a desired moisture content.

The improved method comprises the steps of subjecting a fibrous material (e.g., a continuous stream of moist tobacco particles) to the conditioning action of a gaseous first conditioning medium (e.g., a current of heated air which flows counter to the direction of travel of a stream of moist tobacco through an elongated conditioning zone) having a limited moisture-changing capacity and a first time constant (e.g., the first medium can merely change the moisture content of fibrous material to a certain extent but is capable of effecting such change with a minimum of delay, for example, in response to rapid heating or cooling of the first medium above or below a normal or average temperature), maintaining the conditioning action of the first medium at a predetermined value (e.g., by mixing a predetermined quantity of heated air with a predetermined quantity of cooler air), simultaneously subjecting fibrous material to the conditioning action of a second conditioning medium having a greater moisture-changing capacity but a longer time constant (for example, the second medium may be steam which heats moist tobacco particles in the conditioning zone by flowing through one or more heating coils which are mounted in and rotate with a drum surrounding the conditioning zone whereby the drum and coils subject moist tobacco to an intensive heating action but the interval of time which is required to change the temperature of the drum and coils is relatively long), continuously measuring the moisture content of conditioned fibrous material and producing a first signal when the measured moisture content deviates from a predetermined moisture content whereby a characteristic of the first signal represents the extent of deviation of measured moisture content from the predetermined moisture content, changing the conditioning action of the first medium in immediate response to the first signal so that the action of the first medium then differs from the predetermined value and the first medium acts upon the material to reduce the deviation of measured moisture content from the predetermined moisture content to an extent which is a function of the aforesaid characteristic of the first signal (for example, if the moisture content of conditioned tobacco which issues from the conditioning zone is excessive, a valve which admits cooler atmospheric air into heated air is caused to admit a smaller quantity of cooler air so that the temperature of the first medium rises practically immediately and the first mediam effects a more pronounced drying of tobacco in the conditioning zone), producing a second signal in immediate response to production of the first signal and utilizing the second signal to change the conditioning action of the second medium so as to reduce the deviation of measured moisture content from the predetermined moisture content in response to closing of the aforementioned valve in order to, totalizing the momentary values of the characteristic of the first signal (which changes as soon as the conditioning action of the first medium changes) to produce a third signal corresponding to the sum of momentary values and utilizing the third signal to change the conditioning action of the second medium so as to reduce the deviation of the measured moisture content from the predetermined moisture content in addition to that reduction of such deviation which is caused by the second signal, changing the conditioning action of the first medium back to the predetermined value with a delay which is a function of the time constant of the second medium whereby a characteristic of the second signal changes accordingly, and terminating the third signal when the conditioning action of the first medium again matches the predetermined value so that the conditioning action of the second medium is thereupon controlled exclusively by the second signal.

If the method is used to reduce the moisture content of fibrous material, the first medium is preferably a heated gas (most preferably hot air) which is brought in direct contact with fibrous material, and the second conditioning medium preferably expels moisture from the fibrous material by conduction (e.g., the second medium may be steam which heats a drum wherein the material is being transported through the conditioning zone).

As stated above, the fibrous material is preferably conveyed in the form of a continuous stream passing in a predetermined direction through an elongated conditioning zone which can be defined and surrounded by a rotary drum and wherein the material is subjected to the conditioning action of the first and second media, and the first medium is preferably conveyed through the conditioning zone by flowing counter to the predetermined direction. The conditioning zone is surrounded by a surface (of the aforementioned rotary drum and of the steam conveying coil or coils in the drum) which is heated by the second medium and is contacted by fibrous material while the material is being conveyed through the conditioning zone.

BRIEF DESCRIPTION OF THE DRAWING

The single FIGURE is a partly diagrammatic elevational view of a conditioning apparatus which embodies the invention.

DESCRIPTION OF THE PREFERRED EMBODIMENTS

The conditioning apparatus which is shown in the drawing comprises a conveyor 1 including a rotary drum 2 which defines an elongated conditioning zone and is supported by two groups of rollers 7 (only one group shown) which are mounted in upright frame members 5. The peripheral surface of the drum 2 has two ring-shaped portions 4 (only one shown) which contact the respective groups of rollers 7. The means for rotating the drum 2 comprises an electric motor 8 which rotates the input element of a variable-speed transmission 108 by way of a first belt or chain drive **8*a*. A second belt or chain drive 108*a* receives motion from the output element of the transmission 108 and drives a shaft 108*b* which carries a pinion 6 in mesh with a ring gear 3 on the drum 2.**

The means for feeding a continuous stream of moist tobacco particles 9 into the left-hand end of the conditioning zone in the rotating drum 2 comprises a belt conveyor 11 and a fixedly mounted downwardly inclined chute 12. The means for receiving conditioned tobacco particles 13 from the drum 2 comprises a fixed chute 14, the trough 16 of a vibratory conveyor and a take-off conveyor 17. The latter can transport conditioned tobacco particles to a further processing station, e.g., into the magazine of a cigarette rod making machine. The vibratory conveyor which includes the trough 16 further comprises an electric motor **16*a* having an output shaft which carries a disk serving to move a connecting rod 16*b* which is articulately connected to the trough 16. The latter is mounted on several sets of leaf springs 16***c*.

The particles of tobacco which pass through the conditioning zone in the drum 2 are dried by a hot gaseous fluid conditioning medium which flows counter to the direction of tobacco transport, and by the drum 2 which is heated by a second conditioning medium, e.g., steam. The hot gaseous medium which comes into direct contact with tobacco particles in the drum 2 is preferably air.

The current of air which contacts the particles of tobacco in the drum 2 is admitted through an inlet 18 at the tobacco discharging end of the drum and is evacuated through an outlet 19 at the intake end of the drum. The means for causing the current of hot air to flow through the conditioning zone counter to the direction of tobacco transport comprises a fan 21 which is connected to and draws air from the outlet 19. The inlet 18 receives the current of hot air from a supply pipe or conduit 20 which contains a blower 23. The intake end of the blower 23 is connected with a suction pipe 26 the open end of which contains an electric resistance heater 22. A valve (here shown as a flap 24) is installed in the wall of the suction pipe 26 to admit relatively cold atmospheric air and to thereby reduce the temperature of air which flows in the pipe 20 toward and into the inlet 18. It is preferred to supply to the inlet 18 a current of hot air at a constant rate.

The position of the valve 24 (and hence the temperature of air flowing in the pipe 20) can be adjusted by a motor 27 which is connected to the output of an amplifier 32. If the signal from the amplifier 32 causes the motor 27 to pivot the valve 24 counter-clockwise, as viewed in the drawing, the percentage of relatively cold fresh air which is mixed with hot air while flowing toward and in the pipe 20 increases so that the intensity of heating action of air in the conditioning zone decreases. If the temperature of the drum 2 remains constant, the moisture content of tobacco particles increases. The resistance heater 22 heats that portion of the air current which enters the suction pipe 26 through the left-hand end, as viewed in the drawing. Inversely, the ratio of hot air to cool air in the suction pipe 26 increases if the motor 27 is caused to pivot the valve 24 clockwise whereby the current of air in the conditioning zone expels a higher percentage of moisture from tobacco particles which travel from the chute 12 toward the chute 14.

The motor 27 and valve 24 form part of a control unit 25 which further includes a preferably highly sensitive and accurate moisture detector 28 mounted in the vibrating trough 16. The detector 28 may be of the type known as HWK produced by Hauni-Werke, of Hamburg, Western Germany. A characteristic of the (first) electric signal which is transmitted by the moisture detector 28 to a junction 29 is compared with the corresponding characteristic of a signal which is supplied by a preferably adjustable rated value selector 31 (e.g., a potentiometer). The characteristic of the signal from the selector 31 is indicative of the desired or optimum final moisture content of tobacco particles 13. When the characteristic of signal which is furnished by the detector 28 deviates from the characteristic (e.g., voltage) of signal supplied by the selector 31, the moisture content of tobacco particles 13 is either too high or too low, and the junction 29 then transmits a signal to a second junction 30 which transmits signals to the amplifier 32. The junction 30 is further connected with a temperature detector 35 in the supply pipe 20. The detector 35 is preferably a temperature-sensitive semiconductor of the PTC- or NTC-type.

The motor 27 transmits signals to a junction 130 which is further connected to a preferably adjustable potentiometer 33. A characteristic (e.g., voltage) of signal from the motor 27 to the junction 130 matches the corresponding characteristic of signal from the potentiometer 33 when the valve 24 assumes an intermediate or neutral position, namely a position in which the valve 24 is normally held and which is selected in such a way that the temperature of air in the pipe 20 increases abruptly if the valve 24 is pivoted clockwise and that the temperature of air in the pipe 20 decreases abruptly if the valve 24 is pivoted counterclockwise, as viewed in the drawing. The retention of valve 24 in such neutral position is desirable because the control unit 25 is then ready to rapidly increase or decrease the moisture content of tobacco particles as soon as the detector 28 in the trough 16 produces a (first) signal whose characteristic deviates from the characteristic of signal from the selector 31, i.e., when the moisture content of conditioned tobacco particles is unsatisfactory. It is clear that the junction 130 can be connected directly with the output of the junction 30 since the characteristic of signal from such output is also indicative of the (imminent) position of valve 24. All that counts is to enable the junction 130 to furnish a (second) signal whose characteristic is indicative of the position of the valve 24, i.e., whether the valve 24 is held at the one or the other side of its neutral position.

The output of the junction 130 is connected with one input of a further junction 34 in a control unit 38 which regulates the temperature of the drum 2. A second input of the junction 34 is connected with a rated value selector 36 (preferably an adjustable potentiometer) which supplies a signal indicating the desired or optimum temperature of the drum 2. The characteristic of signal at the output of the junction 34 is indicative of the difference between the characteristics of signals from 130 and 36, and such output signal is transmitted to the input *a* of a proportional-plus-integral amplifier 37 (also called P-I amplifier). The (third) signal at the output *b* of the amplifier 37 is the signal at the input *a* times a constant amplification factor and the time derivative of the input signal. A feature of a P-I amplifier is that it transmits, without delay, a corresponding output signal in response to an abrupt change in the intensity of input signal. In addition, a characteristic value (e.g., voltage) of output signal increases with time as a function of the I-ratio. The speed at which the intensity of output signal increases depends on the extent of abrupt change of the intensity of input signal.

The output *b* of the P-I amplifier 37 is connected with a junction 44 which further receives signals from a transducer 43 here shown as a gauge which monitors the pressure of steam in a conduit 40. The conduit 40 connects a steam generator 39 with several coils 42 which are mounted in and rotate with the drum 2. The coils 42 serve as a means for heating the drum 2 and as a means for agitating the particles of tobacco in the conditioning zone while the particles travel from the chute 12 toward the chute 14. The rate of steam admission into the coils 42 is regulated by an adjustable valve 41 which is installed in the pipe 40 and is controlled by a motor 140 receiving signals from an amplifier 46 which is connected with the output of the junction 44. The temperature of the drum 2 is a function of steam pressure in the coils 42. The particles of tobacco in the conditioning zone are heated by the coils 42, by the drum 2 and by the current of hot air flowing from the inlet 18 toward the outlet 19. It will be readily appreciated that the thermal inertia of drum 2 and coils 42 is much greater than that of the current of hot air in the conditioning zone, i.e., it takes much longer to change the temperature of parts 2 and 42 than to change the temperature of air which flows into the inlet 18 and thence into the interior of the drum 2. However, the moisture-expelling ability of the heating means 2, 42 exceeds the moisture-expelling ability of the current of hot gas.

For example, the temperature of the air current flowing into the inlet 18 can be changed substantially within an interval of 3–5 seconds. On the other hand, the length of the interval which is necessary to effect an appreciable change of the temperature of drum 2 can be 5–7 minutes.

Second-order electronic systems which can be used in the conditioning apparatus to perform the function of the amplifier 37 are disclosed, for example, on pages 139–142 of "Principles of Control Systems Engineering" by Del Toro and Parker, published in 1960 by McGraw Hill Book Company, Inc., of New York City.

The operation:

The conveyor belt 11 delivers moist tobacco particles 9 at a constant rate; to this end, the conveyor 11 can receive moist tobacco particles from a suitable weighing device which insures that each increment of the tobacco stream on the upper stretch of the conveyor 11 contains the same quantity of tobacco or that the conveyor 11 transports identical quantities of tobacco particles per unit of time. The stream of tobacco particles 9 passes through the chute 12 and enters the intake end of the drum 2 to be transported through the conditioning zone owing to slight downward inclination of the drum axis in a direction from the chute 12 toward the chute 14. The drum 2 is driven by the motor 8 whereby the coils 42 act not unlike paddles or blades which agitate the particles of tobacco during travel toward the chute 14 and thus insure a highly satisfactory exchange of heat between tobacco particles on the one hand and the internal surface of the drum 2, coils 42 and current of hot air on the other hand. The main heating action is furnished by the drum 2 and coils 42, especially by the coils 42. The exchange of heat between tobacco and drum 2, coils 42 and hot air in the conditioning zone results in a reduction of moisture content of tobacco so that, when the heating action of steam upon the parts 2 and 42 is constant, and when the pipe 20 admits into the drum 2 a hot air current at a constant rate and at a constant temperature, the moisture content of conditioned tobacco particles 13 which leave the conditioning zone via chute 14 and travel in the trough 16 is also constant, provided that the moisture content of particles 9 on the upper stretch of the conveyor 11 is constant. Conditioned tobacco particles 13 which leave the trough 16 are accepted by the take-off conveyor 17 and are advanced to a further processing station. Spent hot air which reaches the outlet 19 at the tobacco receiving end of the drum 2 is withdrawn by the fan 21 and is discharged into the atmosphere or recycled (at least in part) into the suction pipe 26.

If the moisture content of conditioned tobacco particles 13 deviates from an optimum moisture content, e.g., if the moisture content of tobacco particles in the trough 16 is too high, the detector 28 transmits a signal to the junction 29 where the signal is compared with the signal from the selector 31. The signal at the output of the junction 29 is indicative of the deviation of measured moisture content from the optimum moisture content, and such signal is transmitted to the junction 30 which compares the signal from the junction 29 with the signal from the detector 35. The junction 30 transmits a signal to the amplifier 32 which causes the motor 27 to pivot the valve 24 in a clockwise direction so that the temperature of hot air in the pipe 20 rises almost immediately and the current of hot air in the conditioning zone subjects the particles of tobacco to a more pronounced drying action. The valve 24 remains in the adjusted position (in which it reduces the inflow of cold atmospheric air into the suction pipe 26) as long as the signal from the detector 35 to the junction 30 deviates from the signal which is being transmitted from the junction 29 to the junction 30. It will be noted that the control unit 25 effects a very rapid change in the heating action of air current in the conditioning zone so that the moisture content of tobacco particles which leave the drum 2 via chute 14 is reduced almost instantaneously.

However, the range of conditioning action of hot air in the drum 2 is rather limited; therefore, it is desirable to rapidly return the valve 24 to its normal or neutral position so that the control unit 25 is ready to rapidly reduce the moisture content of tobacco particles when the detector 28 again produces a signal which is indicative that the moisture content of tobacco particles in the trough 16 is excessive. If the deviation of measured moisture content of tobacco particles 13 from a desired or optimum moisture content is permanent or longer-lasting, the particles of tobacco in the conditioning zone should be subjected to a more pronounced heating and drying action which is to be furnished by the drum 2 and coils 42, especially since the valve 24 reassumes its neutral position as soon as the intensity of signal from the detector 35 to the junction 30 matches the intensity of signal from the junction 29 to junction 30. This is achieved as follows:

The junction 130 transmits a signal to the junction 34 as soon as the motor 27 moves the valve 24 from its neutral position. The junction 130 may be omitted in its entirety if the motor 27 includes means for adjusting the potentiometer 33 in such a way that the a signal from the potentiometer 33 to the junction 34 is indicative of the position of valve 24, i.e., of the ratio of cold air to heated air in the suction pipe 26. The junction 34 compares the (second) signal from the potentiometer 33 or junction 130 with the signal from selector 36 and transmits a signal to the input *a* of the P-I amplifier 37. The characteristic of signal at the input *a* of the amplifier 37 matches the difference between the characteristic of signal from amplifier 33 and the characteristic of signal from selector 36. The output *b* of the P-I amplifier immediately transmits a (third) signal whose characteristic is a function of the extent to which the signal at the input *a* has been changed due to movement of the valve 24 from its neutral position (P-ratio). The signal from the output *b* of the amplifier 37 is immediately transmitted to the junction 44 which transmits it to the motor 140 for the regulating valve 41 whereby the latter admits more steam into the coils 42. The pressure of steam in the pipe 40 (downstream of the valve 41) is monitored by the transducer 43 which transmits a corresponding signal to the junction 44.

The pipe 40 may define two coaxial paths, namely an inner path for the flow of hot steam from the steam generator 39 into the coils 42 and an annular outer path for the return flow of spent steam from the coils 42 into the steam generator 39.

As stated above, the inertia or time constant of drum 2 and coils 42 is relatively high, i.e., the heating action of these parts upon the particles of tobacco in the conditioning zone is felt with a certain delay. In the absence of P-I amplifier 37, the valve 24 would return to its neutral position as soon as the particles of tobacco in the conditioning zone would be subjected to a more pronounced heating action of the drum 2 and coils 42. This would be of no help since the drying action of hot air in the drum 2 would decrease and the moisture content of tobacco particles 13 would again exceed the desired or optimum moisture content. Moreover, the signal from potentiometer 33 to the junction 34 would disappear and, in the absence of amplifier 37, the servomotor 140 would reset the valve 41 so that the pressure of steam in the coils 42 would decrease and the heating action of drum 2 and coils 42 would be reduced.

The I-stage of the P-I amplifier 37 causes the output *b* to transmit to the junction 44 a signal whose intensity increases with time, and the rate at which the intensity of such signal increases is proportional with the intensity of signal which has been transmitted by potentiometer 33 to the junction 34 to indicate the changed position of the valve 24. Otherwise stated, the rate at which the intensity of signal at the output *b* of amplifier 37 increases is higher if the valve 24 has been moved to a new position (to reduce the ratio of cold air to hot air in the suction pipe 26) which is substantially different from the neutral or normal position. When the P-stage of signal at the output *b* of the amplifier 37 disappears, i.e., when the temperature of the drum 2 and coils 42 has increased sufficiently to take over that share of the heating action which has been performed by hot air due to movement of the valve 24 from its neutral position, and the valve 24 gradually returns to the neutral position because the signal from detector 28 is indicative of a reduction of deviation of measured moisture content from desired or selected final moisture content, the I-stage continues to be felt at the junction 44 so that the valve 41 allows steam to pass into the coils 42 at a rate which is necessary to compensate for reduced heating action of the air current (because the valve 24 has been returned to its neutral position) as well as to insure that the heating action of drum 2 and coils 42 suffices to reduce the moisture content of tobacco particles to a value which is determined by the setting of selector 31.

The operation of the control units 25 and 38 is analogous when the detector 28 produces a signal which is indicative of insufficient moisture content of tobacco particles 13 in the trough 16. The motor 27 then pivots the valve 24 in a counterclockwise direction so as to reduce the temperature of hot air in the pipe 20 and the P-I amplifier 37 causes a lasting reduction of steam pressure in the coils 42 to thus reduce the heating action of coils 42 and drum 2.

An advantage of the improved method and apparatus is that the current of hot air is capable of changing (without any delay or with negligible delay) the moisture content of tobacco particles 13 when the measured moisture content is too high or too low, and that the temperature of hot air can be changed back to a predetermined temperature as soon as the inertia of heating means including the drum 2 and coils 42 has been overcome whereby the parts 2 and 42 not only influence the drying of tobacco particles in the conditioning zone to the extent which is necessary to insure that the measured moisture content will not deviate from a desired moisture content but also to the extent which is necessary to compensate for a more or less intensive heating action of air in the drum 2 as a result of return movement of the valve 24 to its neutral position.

Another advantage of the improved method and apparatus is that the adjustments of both conditioning actions (by hot air and by the parts 2, 42) are effected automatically so that the quantity of tobacco whose moisture content deviates from a desired optimum content is negligible because it does not depend on the skill, conscientiousness and/or presence of attendants.

What is claimed as new and desired to be protected by Letters Patent is set forth in the appended claims:

1. A method of changing the moisture content of fibrous material, particularly tobacco, comprising the steps of subjecting fibrous material to the action of a gaseous medium having a limited capacity to change the moisture content of fibrous material and to change said moisture content at a relatively high rate of speed; maintaining said action at a predetermined value; simultaneously subjecting the fibrous material to the action of a fluid medium having a greater capacity to change the moisture content of fibrous material and to change said moisture content at a relatively low rate of speed; continuously measuring the thus changed moisture content of fibrous material and producing a first signal when the measured moisture content deviates from a predetermined moisture content whereby the intensity of said first signal represents the extent of deviation; changing the moisture-changing action of said gaseous medium in immediate response to the production of said first signal so that the moisture-changing action of said gaseous medium differs from said predetermined value and the gaseous medium acts upon the fibrous material to reduce the deviation of measured moisture content from said predetermined moisture content to an extent which is a function of the intensity of said first signal; utilizing said first signal to produce a second signal in immediate response to the production of said first signal and utilizing said second signal to change the moisture-changing action of said fluid medium so as to reduce said deviation; totalizing the momentary values of intensity of said second signal to produce a third signal having an intensity corresponding to the sum of said momentary values and utilizing said third signal to change the moisture-changing action of said fluid medium so as to reduce said deviation in addition to that reduction which is due to the moisture-changing action of said fluid medium in response to said second signal; changing the moisture-changing action of said gaseous medium back to said predetermined value whereby the intensity of said second signal changes; and terminating said third signal when the moisture-changing action of said gaseous medium matches said predetermined value so that the moisture-changing action of said fluid medium is thereupon determined by said second signal.

2. A method as defined in claim 1 for reducing the moisture content of fibrous material, wherein said gaseous medium is a heated gas and said fluid medium extracts moisture from fibrous material by conduction, said first mentioned step comprising maintaining said heated gas in direct contact with fibrous material.

3. A method as defined in claim 1 for reducing the moisture content of fibrous material, wherein said gaseous medium is a heated gas and said fluid medium extracts moisture from fibrous material by radiation, said first mentioned step comprising maintaining said heated gas in direct contact with fibrous material.

4. A method as defined in claim 1 for reducing the moisture content of fibrous material, wherein said gaseous medium is a heated gas and said first mentioned step comprises maintaining said heated gas in direct contact with fibrous material, and further comprising the steps of conveying the fibrous material in a predetermined direction through a conditioning zone wherein the moisture content of conveyed fibrous material is changed by said heated gas and said fluid medium, and conveying said heated gas through the conditioning zone counter to said predetermined direction.

5. Apparatus for changing the moisture content of fibrous material, particularly tobacco, comprising means for subjecting fibrous material in a conditioning zone to the direct action of a gaseous medium having a limited capacity to change the moisture content of fibrous material and to change said moisture content at a relatively high rate of speed; adjustable means for changing the moisture-changing action of said gaseous medium and for normally maintaining said action at a predetermined value; means for subjecting the fibrous material in said zone to the action of a fluid medium having a greater capacity to change the moisture content of fibrous material and to change said moisture content at a relatively low rate of speed; means for measuring the changed moisture content of said fibrous material and for producing a first signal when the measured moisture content deviates from a predetermined moisture content whereby the intensity of said first signal represents the extent of deviation; means for adjusting said changing means in immediate response to said first signal so that the moisture-changing action of said gaseous medium upon the fibrous material in said zone is changed from said predetermined value to reduce said difference to an extent which is a function of the intensity of said first signal; second adjustable means for changing the moisture-changing action of said fluid medium; and means for adjusting said second changing means in response to said first signal, including means for producing a second signal which is indicative of the extent of deviation of moisture-changing action of said gaseous medium from said predetermined value in response to said first signal, and a proportional-and-integral amplifier having means for immediately changing the moisture-changing action of said fluid medium in response to said second signal so as to reduce said difference and for changing the moisture-changing action of said fluid medium so as to reduce said difference to an extent which is a function of deviation of intensity of said second signal from a predetermined intensity.

6. Apparatus as defined in claim 5, wherein said gaseous medium is heated air and said first changing means comprises a valve which is adjustable to change the temperature of said heated air, said first mentioned adjusting means comprising a motor arranged to adjust said valve in response to said first signal, said means for producing said second signal being operatively connected with said motor and the intensity of said second signal being proportional to the extent of adjustment of said valve by said motor.

7. Apparatus as defined in claim 5, wherein said fluid medium is steam and said second changing means comprises an adjustable steam valve and motor means for adjusting said steam valve in response to signals from said amplifier.

* * * * *